US009878540B2

(12) United States Patent
Wakabayashi

(10) Patent No.: US 9,878,540 B2
(45) Date of Patent: Jan. 30, 2018

(54) LIQUID EJECTING METHOD

(71) Applicant: Seiko Epson Corporation, Tokyo (JP)

(72) Inventor: Shigemi Wakabayashi, Azumino (JP)

(73) Assignee: Seiko Epson Corporation (JP)

( * ) Notice: Subject to any disclaimer, the term of this patent is extended or adjusted under 35 U.S.C. 154(b) by 0 days.

(21) Appl. No.: 15/467,270

(22) Filed: Mar. 23, 2017

(65) Prior Publication Data

US 2018/0001629 A1 Jan. 4, 2018

(30) Foreign Application Priority Data

Jun. 29, 2016 (JP) ..... 2016-128512

(51) Int. Cl.

| | |
|---|---|
| ***B41J 2/14*** | (2006.01) |
| ***B41J 11/00*** | (2006.01) |
| ***B41J 2/21*** | (2006.01) |
| *B41J 2/01* | (2006.01) |
| *B41J 2/36* | (2006.01) |

(52) U.S. Cl.

CPC ..... *B41J 2/1433* (2013.01); *B41J 2/1404* (2013.01); *B41J 2/2132* (2013.01); *B41J 11/008* (2013.01); *B41J 2/01* (2013.01); *B41J 2/36* (2013.01)

(58) Field of Classification Search

CPC . B41J 2/1433; B41J 2/01; B41J 2/1404; B41J 11/008; B41J 2/2132; B41J 2/36

See application file for complete search history.

(56) References Cited

U.S. PATENT DOCUMENTS

| | | | | |
|---|---|---|---|---|
| 5,628,937 | A * | 5/1997 | Oliver | B01D 1/18 159/4.4 |
| 2003/0039762 | A1* | 2/2003 | Watanabe | B01J 19/0046 427/422 |
| 2010/0151142 | A1* | 6/2010 | Cornell | B41J 2/1606 427/508 |
| 2011/0211002 | A1 | 9/2011 | Nishimura | |
| 2013/0135397 | A1 | 5/2013 | Nishimura et al. | |

FOREIGN PATENT DOCUMENTS

| | | | |
|---|---|---|---|
| JP | 2011-177920 | A | 9/2011 |
| JP | 2012-011635 | A | 1/2012 |
| JP | 2013-111865 | A | 6/2013 |

* cited by examiner

*Primary Examiner* — Henok Legesse

(74) *Attorney, Agent, or Firm* — Harness, Dickey & Pierce, P.L.C.

(57) ABSTRACT

A liquid ejecting method includes ejecting droplets of an oil-based ink containing an oil-based medium onto a recording medium by using an ink jet head having a plurality of nozzles under the conditions satisfying relationships (1): $f \times D \geq 4800$; and relationship (2): $5 \leq \rho V d/\eta \leq 30$. In the relationships (1) and (2), D represents the nozzle pitch in dpi of the ink jet head, f represents the maximum ejection frequency in kHz, V represents the velocity in m/s of droplets ejected from the ink jet head, d represents the diameter in μm of the droplets of the oil-based ink, ρ represents the density in $g/cm^3$ of the oil-based ink, and η represents the viscosity in mPa·s of the oil-based ink.

6 Claims, 2 Drawing Sheets

LIQUID EJECTING METHOD

BACKGROUND

1. Technical Field

The present invention relates to a liquid ejecting method.

2. Related Art

Development of office use ink jet printers is underway. Office use printers are required to enable high-quality, high-speed printing on plain paper and other recording media and to have a function as a finisher that can, for example, bind printed sheets. Accordingly, the recording liquids used in such printers are required to allow the printer to print high-density images on plain paper at a high speed, and also required to reduce strike-through in view of duplex printing. Furthermore, such liquids are required not to cause cockling, curling, or any other deformation of paper after high-speed printing. Aqueous recording liquids containing an aqueous medium can cause deformation of plain paper, such as cockling or curling, when used as an ink for high-speed printing. Accordingly, oil-based inks containing an organic solvent, unlikely to cause paper deformation are being developed.

Line printers are used as ink jet printers for high-speed printing. A line printer includes at least one printing head (hereinafter referred to as line ink jet head in some cases) having a nozzle line with a length corresponding to the width of the recording medium (in a direction intersecting a medium transport direction, in which the recording medium is transported). The line printer prints on a recording medium while transporting the recording medium in the medium transport direction without moving the line ink jet head in a direction intersecting the medium transport direction.

Oil-based inks are used in such a line printer. An oil-based ink may cause crosstalk in the head due to the viscoelasticity thereof, resulting in degraded print quality. To solve this problem, some techniques have been provided. For example, in JP-A-2012-11635, the number of droplets ejected through nozzles is increased to realize both preventing the degradation of print quality and enabling high-speed printing.

Unfortunately, the technique of varying the number of droplets ejected through nozzles requires that the speed for transporting paper or recording medium be finely adjusted. For this operation, the printing speed is reduced and, thus, the performance of the printer is reduced in some cases. Accordingly, it is difficult that this technique enables high-speed printing while stabilizing ejection to prevent the degradation of print quality.

SUMMARY

An advantage of some aspects of the invention is that it provides a liquid ejecting method that enables high-speed printing with a line printer or the like using an oil-based ink while ensuring stable ejection of the liquid applied onto a recording medium by an ink jet method.

The subject matter of the invention can be achieved in the following embodiments or applications.

Application 1

According to an aspect of the invention, there is provided a liquid ejecting method including ejecting droplets of an oil-based ink containing an oil-based medium onto a recording medium by using an ink jet head having a plurality of nozzles so as to satisfy the following relationships:

$$f \times D \geq 4800 \quad (1); \text{ and}$$

$$5 \leq \rho V d / \eta \leq 30 \quad (2).$$

In relationships (1) and (2), D represents the nozzle pitch in dpi of the ink jet head, f represents the maximum ejection frequency in kHz, V represents the velocity in m/s of the droplets ejected from the ink jet head, d represent of the oil-based ink, ρ represents the density in $g/cm^3$ of the oil-based ink, and η represents the viscosity in mPa·s of the oil-based ink.

This liquid ejecting method ensures stable ejection of an oil-based ink onto a recording medium by an ink jet method and thus enables high-quality image printing. In addition, the liquid ejecting method can be used for high-speed printing.

Application 2

The oil-based medium may contain a petroleum-based solvent with a content of 50% by mass or more relative to the total mass of the oil-based medium.

The liquid ejecting method ensures stable ejection of an oil-based ink containing an oil-based medium in which a petroleum-based solvent accounts for 50% by mass or more of the total mass of the medium and thus enables high-quality image printing. In addition, the liquid ejecting method can be used for high-speed printing.

Application 3

Alternatively, the oil-based medium may contain an allyl compound.

The oil-based ink containing an allyl compound as the oil-based medium can be more stably ejected and, accordingly, helps the liquid ejecting method to enable high-quality image printing and high-speed printing.

Application 4

The diameter d of the droplets of the oil-based ink may be in the range of 20 μm to less than 50 μm.

In this instance, the liquid ejecting method further ensures stable ink jet ejection of the oil-based ink onto a recording medium and thus enables high-quality image printing. In addition, the liquid ejecting method can be used for high-speed printing.

Application 5

The droplets of the oil-based ink ejected may have a Weber number We in the range of 25 to 100, and a Reynolds number Re of which the product multiplied by the Weber number We is in the range of 200 to 1500. The Weber number is represented by equation (3): $We=\rho V^2 d/\gamma$, wherein γ represents the surface tension in mN/m of the oil-based ink, and the Reynolds number Re is represented by equation (4): $Re=\rho V d/\eta$.

In this instance, the liquid ejecting method further ensures stable ink jet ejection of the oil-based ink onto a recording medium and thus enables high-quality image printing. In addition, the liquid ejecting method can be used for high-speed printing.

Application 6

The ink jet head may be a line ink jet head in which the plurality of nozzles are arranged in a direction intersecting a direction in which the recording medium is transported.

In this instance, the liquid ejecting method further ensures stable ink jet ejection of the oil-based ink onto a recording medium and thus enables high-quality image printing even in the case of high-speed printing using a line ink jet head.

BRIEF DESCRIPTION OF THE DRAWINGS

The invention will be described with reference to the accompanying drawings, wherein like numbers reference like elements.

DESCRIPTION OF EXEMPLARY EMBODIMENTS

Exemplary embodiments of the invention will now be described. The following embodiments will be described by way of example. The invention is not limited to the disclosed embodiments, and various modifications may be made within the scope and spirit of the invention.

1. Liquid Ejecting Method

In a liquid ejecting method according to an embodiment of the invention, droplets of an oil-based ink containing an oil-based medium are ejected onto a recording medium by using an ink jet head having a plurality of nozzles under the conditions satisfying the following relationships (1) and (2):

$$f \times D \geq 4800 \quad (1); \text{ and}$$

$$5 \leq \rho V d / \eta \leq 30 \quad (2).$$

In the relationships (1) and (2), D represents the nozzle pitch in dpi of the ink jet head, f represents the maximum ejection frequency in kHz, V represents the velocity in m/s of the droplets ejected from the ink jet head, d represents the diameter in μm of the droplets, ρ represents the density in $g/cm^3$ of the oil-based ink, and η represents the viscosity in mPa·s of the oil-based ink.

The velocity V (m/s) of the droplets ejected from the ink jet head refers to the velocity of the droplets of the ejected ink at 1 mm away from the nozzles. The diameter d (μm) of the droplets mentioned herein refers to the sphere-equivalent diameter of the droplets of the ejected ink at 1 mm away from the nozzles.

An exemplary ink jet recording apparatus used in the liquid ejecting method of the present embodiment will be described with reference to the drawings, before describing the liquid ejecting method. The ink jet recording apparatus that can be used in the liquid ejecting method of the present embodiment is not limited to the following apparatus.

1.1. Ink Jet Recording Apparatus

Figure 1:
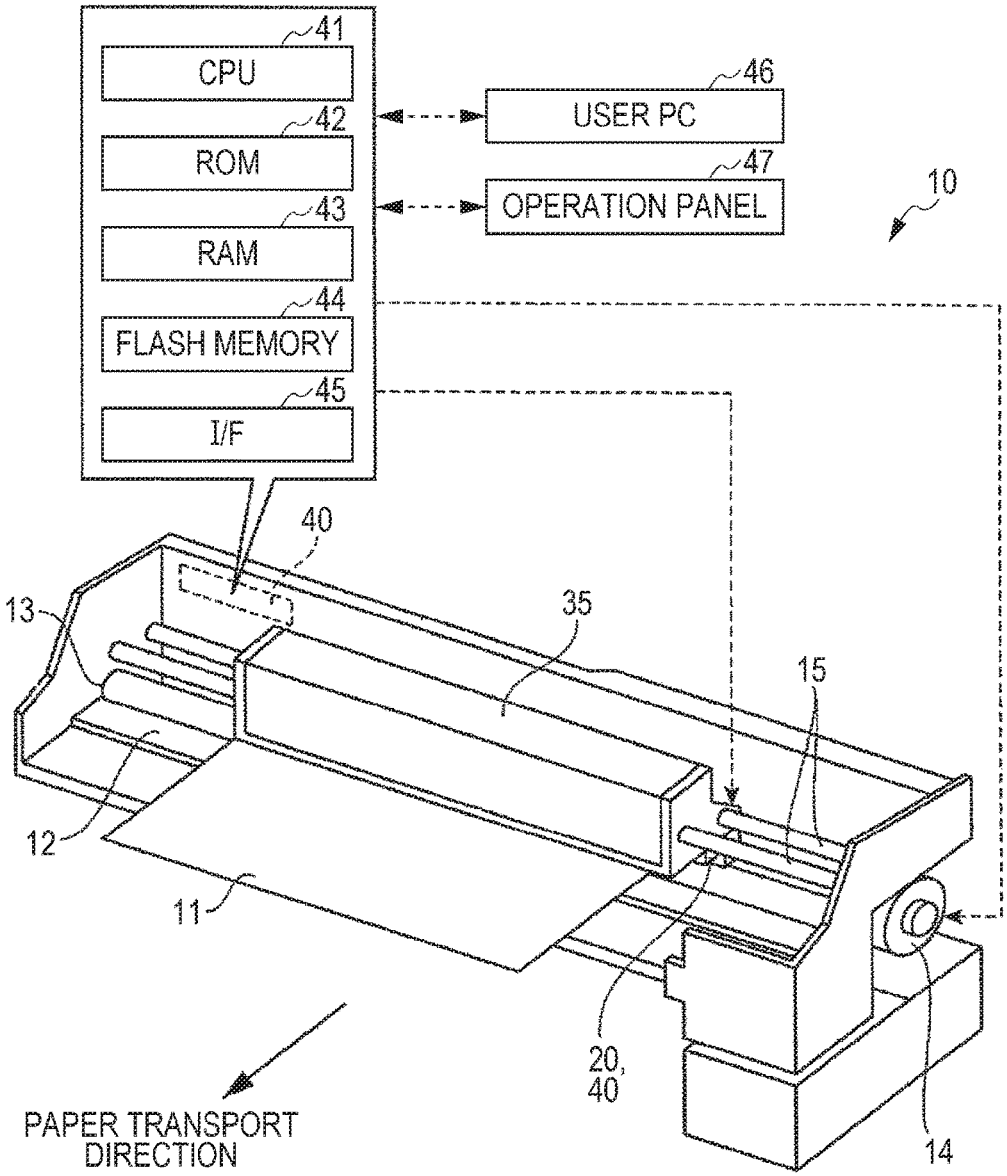
FIG. 1 is a schematic representation of an ink jet recording apparatus including a line ink jet head.

As shown in FIG. 1, the ink jet recording apparatus includes a transport roller 13 configured to transport recording paper 11 over a platen 12, a step motor 14 configured to rotate the transport roller 13, a line ink jet head 20 movable along guide rails 15 in a direction intersecting the direction in which the recording paper 11 is transported (in the direction indicated by the arrow in FIG. 1, hereinafter referred to as a medium or paper transport direction) and configured to eject ink droplets onto the recording paper 11, an ink cartridge 35, and a controller 40 that controls the entirety of the apparatus.

Figure 2:
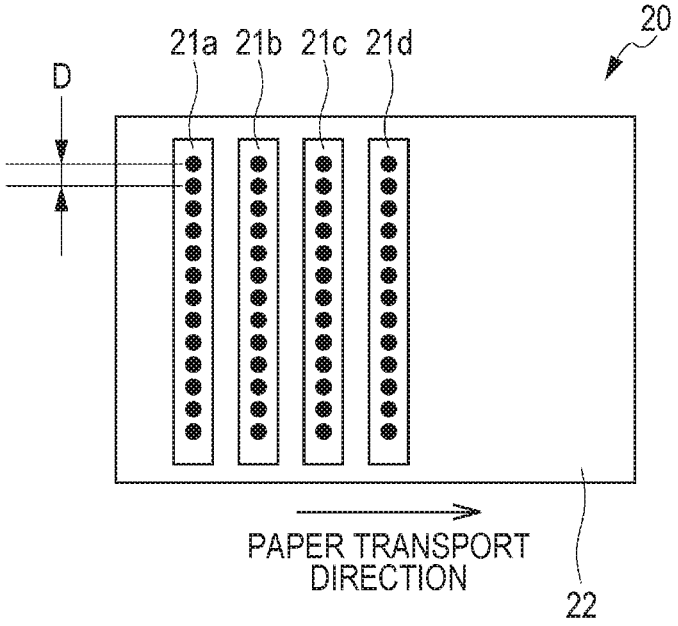
FIG. 2 is a schematic plan view of a line ink jet head.
Figure 3:
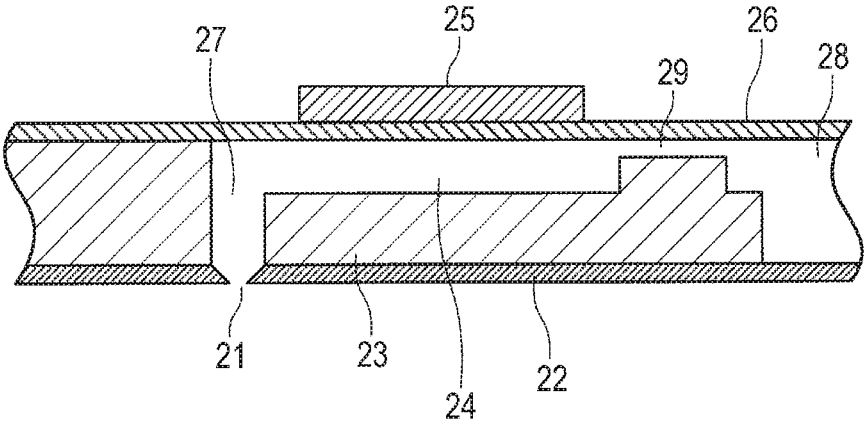
FIG. 3 is a schematic sectional view of a line ink jet head.

In the present embodiment, the line ink jet head 20 is a piezoelectrically driven head. As schematically shown in FIGS. 2 and 3, the line ink jet head 20 includes a nozzle plate 22 in which a plurality of nozzles 21 acting as ink ejection openings are formed with a pitch D (dpi), an ink flow channel substrate 23 in which ink flow channels communicating with the nozzles are formed, and a vibration plate 26 disposed adjacent to pressure chambers 24 formed in the flow channels and capable of transmitting a vibration from each piezoelectric element 25. Each ink flow channel has a communication hole 27 communicating with the corresponding nozzle 21, the pressure chamber 24 that receives pressure from the piezoelectric element 25, a reservoir 28 that temporarily stores the ink supplied from the ink cartridge 35 disposed outside the line ink jet head 20, and a supply port 29 through which the pressure chamber 24 communicates with the reservoir 28.

The controller 40 is in the form of a microprocessor including a CPU 41. The controller 40 also includes a ROM 42 storing processing programs, a RAM 43 temporarily storing data, a flash memory 44 on which data can be written and from which data can be erased, an interface (I/F) 45 through which information is communicated with external devices, and an input and an output port (not shown).

The RAM 43 has a printing buffer region in which printing data transmitted from a user PC 46 through the I/F 45 can be stored. Operational signals or the like are input to the controller 40 from an operation panel 47 through the input port, and the controller 40 outputs driving signals to the line ink jet head 20 or the step motor 14 and output signals to the operation panel 47 through the output port.

The operation panel 47 is a device with which the user inputs instructions and which displays the status of the apparatus, and has a display (not shown) on which letters, characters, and figures are displayed according to instructions, and operational buttons (not shown) for user operation.

FIG. 2 is a schematic plan view of a line ink jet head 20. The line ink jet head 20 has a plurality of nozzle lines 21*a*, 21*b*, 21*c*, and 21*d*, each defined by nozzles aligned in a direction intersecting the paper transport direction. The line ink jet head 20 has a recording region whose length is larger than or equal to the width of the recording paper 11 so that an image corresponding to one line can be recorded on the recording paper 11 at one time. The ink jet recording apparatus 10 forms images on a recording medium by using the nozzle lines 21*a*, 21*b*, 21*c*, 21*d* one after another. In an embodiment, the line ink jet head 20 may be such that a plurality of liquid ejecting heads may be arranged in a staggered manner.

In the present embodiment, the line ink jet head 20 ejects an ink by a method using a pressure generated in the pressure chamber 24 by the piezoelectric element 25, which is a vibration element, as shown in FIG. 3. More specifically, the ink is temporarily delivered to the reservoir 28 in the line ink jet head 20 from the ink cartridge 35, and supplied to the pressure chamber 24 provided for each ejection opening through the supply port 29. In the pressure chamber 24, the ink is then exposed to a pressure generated by the vibration of the piezoelectric element 25 from the vibration plate 26 and thus ejected through the communication hole 27 and the nozzle 21.

In an embodiment, the ink jet head may be a serial ink jet head instead of the foregoing line ink jet head. In this instance, the ink jet recording apparatus including a serial ink jet head performs recording by repetition of scanning operation (pass) for ejecting an ink while moving the recording head relatively to the recording medium. For example, the serial ink jet recording head may be mounted on a carriage that moves in the width direction of the recording medium (intersecting the medium transport direction), thus ejecting droplets while moving accompanying the movement of the carriage.

1.2. Oil-Based Ink

The oil-based ink used in the liquid ejecting method of the present embodiment, which is a method for ejecting an oil-based ink onto a recording medium by using an ink jet head, can satisfy the following relationships (1) and (2):

$$f \times D \geq 4800 \quad (1); \text{ and}$$

$$5 \leq \rho V d / \eta \leq 30 \quad (2).$$

In the relationships (1) and (2), D represents the nozzle pitch in dpi of the ink jet head, f represents the maximum ejection frequency in kHz, V represents the velocity in m/s of the droplets ejected from the ink jet head, d represents the diameter in μm of the droplets, ρ represents the density in $g/cm^3$ of the oil-based ink, and η represents the viscosity in mPa·s of the oil-based ink.

The oil-based ink used herein refers to a composition the medium of which mainly contains an organic solvent or the like, but not water. The water content in the oil-based ink is preferably 5% by mass or less, more preferably 3% by mass or less, still more preferably 2% by mass or less, further preferably 1% by mass or less, still further preferably 0.5% by mass or less, relative to the total mass (100% by mass) of the composition. The content of the organic solvent or the like is preferably 50% by mass or mores, more preferably 70% by mass or more, still more preferably 80% by mass or more, still further preferably 90% by mass or more, relative to the total mass (100% by mass) of the ink composition. The oil-based ink, however, may contain water unintentionally inevitably added in the process of preparation thereof.

The oil-based ink may be, for example, an oil-based ink jet ink containing an oil-based medium in which a petroleum-based solvent accounts for 50% by mass or more of the total mass of the medium.

1.2.1. Pigment

In the present embodiment, the oil-based ink may contain a pigment as a coloring material. The pigment may be an inorganic or an organic color pigment conventionally used in oil-based ink jet inks. Such pigments may be used singly or in combination.

Examples of the pigment that can be used in the oil-based ink include azo pigments, such as azo lake, insoluble azo pigments, condensed azo pigments, and chelate azo pigments; polycyclic pigments, such as phthalocyanine pigments, perylene and perylene pigments, anthraquinone pigments, quinacridone pigments, dioxazine pigments, thioindigo pigments, isoindolinone pigments, and quinophthalone pigments; dye lakes, such as basic dye lakes and acid dye lakes; other organic pigments, such as nitro pigments, nitroso pigments, aniline black, and daylight fluorescent pigments; and inorganic pigments, such as carbon black.

More specifically, when the oil-based ink used in the present embodiment is a magenta or a red ink, examples of the pigment used in such an ink include C. I. Pigment Red 2, C. I. Pigment Red 3, C. I. Pigment Red 5, C. I. Pigment Red 6, C. I. Pigment Red 7, C. I. Pigment Red 15, C. I. Pigment Red 16, C. I. Pigment Red 48:1, C. I. Pigment Red 53:1, C. I. Pigment Red 57:1, C. I. Pigment Red 122, C. I. Pigment Red 123, C. I. Pigment Red 139, C. I. Pigment Red 144, C. I. Pigment Red 149, C. I. Pigment Red 166, C. I. Pigment Red 170, C. I. Pigment Red 177, C. I. Pigment Red 178, C. I. Pigment Red 194, C. I. Pigment Red 209, C. I. Pigment Red 222, C. I. Pigment Red 224, and C. I. Pigment Violet 19.

When the oil-based ink used in the present embodiment is an orange or a yellow ink, examples of the pigment used in such an ink include C. I. Pigment Orange 31, C. I. Pigment Orange 43, C. I. Pigment Orange 64, C. I. Pigment Yellow 12, C. I. Pigment Yellow 13, C. I. Pigment Yellow 14, C. I. Pigment Yellow 15, C. I. Pigment Yellow 17, C. I. Pigment Yellow 74, C. I. Pigment Yellow 93, C. I. Pigment Yellow 94, C. I. Pigment Yellow 128, C. I. Pigment Yellow 138, C. I. Pigment Yellow 150, and C. I. Pigment Yellow 180.

When the oil-based ink used in the present embodiment is a green or a cyan ink, examples of the pigment used in such an ink include C. I. Pigment Blue 15, C. I. Pigment Blue 15:2, C. I. Pigment Blue 15:3, C. I. Pigment Blue 15:4, C. I. Pigment Blue 16, C. I. Pigment Blue 60, C. I. Pigment Green 7, and C. I. Pigment Green 36.

When the oil-based ink is a black ink, the pigment may be carbon black.

When the oil-based ink is a white ink, examples of the pigment include C. I. Pigment White 6, C. I. Pigment White 18, and C. I. Pigment White 21.

Commercially available pigments may be used. Suitable commercially available black pigments include Mitsubishi Chemical carbon blacks MA11, MA100, MA220, MA600a, #40, and #44. Commercially available pigments other than black include SYMULER Brilliant Carmine 6B, SYMULER Red, FASTOGEN Super Magenta, SYMULER Fast Yellow, FASTOGEN Blue 4RO-2, FASTOGEN Green, and FASTOGEN Super Violet, each produced by DIC. Pigments may be used singly or in combination.

The pigment content in the oil-based ink used in the present embodiment is appropriately determined according to the use or printing properties, and is preferably in the range of 0.01% to 20% by mass, more preferably 0.5% to 15% by mass, and still more preferably 1% to 10% by mass, relative to the total mass (100% by mass) of the recording liquid or oil-based ink from the viewpoint of obtaining a good hiding property and good color reproduction.

In the present embodiment, the primary particles of the pigment preferably have an aspect ratio in the range of 1.0 to 2.0. Since particles having such an aspect ratio are near spheroidal, the interaction (attraction) among the particles decreases. Thus, flocculation causing unstable ejection can be prevented from occurring at the nozzles when the ink is ejected. In addition, since such pigment particles are stably dispersed in the ink, the viscosity of the ink does not increase. Therefore, the oil-based ink can be stably stored and stably ejected. Furthermore, such a pigment is unlikely to rub the surfaces defining nozzles or to damage the surfaces during wiping for cleaning the ink jet head. Thus, the oil-based ink helps increase the resistance to wiping of the nozzles.

The aspect ratio of the primary particles of the pigment, mentioned herein is the average of the aspect ratio, defined by (longer axis length)/(shorter axis length), of each primary particle. More specifically, the image of each pigment particle is taken by observing the powder of the pigment under a transmission electron microscope (TEM) or a scanning electron microscope (SEM). Then, the particle size (diameter) of each pigment particle is measured from the barycenter of the image at angles of 0° to 179° in increments of 1°, and the largest of the 180 measured values thus obtained is defined as the longer axis length of the particle, and the shortest of the 180 measured values is defined as the shorter axis length. Aspect ratios of 100 particles or more thus determined are averaged to yield the aspect ratio of the pigment particles.

1.2.2. Oil-Based Medium

The oil-based ink used in the present embodiment contains an oil-based medium. The term "oil-based medium" used herein refers to a liquid medium that contains an organic solvent and allows the pigment and other ingredients to be dispersed therein, and is liquid at room temperature under normal pressure. If the liquid medium is a mixture of an organic solvent and any other substance, the liquid medium contains more than 5% by mass of organic solvent.

The oil-based medium used in the oil-based ink of the present embodiment may contain any of known vegetable oils and petroleum-based solvents, and these solvents may be a polar organic solvent or a nonpolar organic solvent. Alternatively, an allyl compound may be used as the oil-based medium.

Nonpolar Organic Solvent

Examples of the nonpolar organic solvent that may be used in the oil-based ink of the present embodiment include hydrocarbon solvents that are petroleum-based solvents, fluorocarbon solvents, and silicone solvents. Exemplary petroleum-based solvents include aliphatic hydrocarbon solvents, alicyclic hydrocarbon solvents, and aromatic hydrocarbon solvents. A commercially available aliphatic hydrocarbon or alicyclic hydrocarbon solvent may be used, and examples thereof include Teclean N-16, Teclean N-20, Teclean N-22, Nisseki Naphthesol L, Nisseki Naphthesol M, Nisseki Naphthesol H, No. 0 Solvent L, No. 0 Solvent M, No. 0 solvent H, Nisseki Isosol 300, Nisseki Isosol 400, AF-4, AF-5, AF-6, and AF-7 (each manufactured by JX Nippon Oil & Energy); and Isopar G, Isopar H, Isopar L, Isopar M, Exxsol D40, Exxsol D80, Exxsol D100, Exxsol D130, and Exxsol D140 (each produced by Exxon Mobil). Exemplary aromatic hydrocarbon solvents include Nisseki Cleansol G (alkylbenzene, manufactured by JX Nippon Oil & Energy) and Solvesso 200 (produced by Exxon Mobil).

Polar Organic Solvent

Examples of the polar organic solvent that may be used in the oil-based ink of the present embodiment include ester-based solvents, alcohol-based solvents, amide-based solvents, fatty acid-based solvents, and ether-based solvents.

For example, the ester-based solvent may be a higher fatty acid ester having a carbon number of 5 or more, preferably 9 or more, more preferably 12 to 32, and examples thereof include isodecyl isononanoate, isotridecyl isononanoate, isononyl isononanoate, methyl laurate, isopropyl laurate, isopropyl myristate, isopropyl palmitate, isooctyl palmitate, hexyl palmitate, isostearyl palmitate, isooctyl isopalmitate, methyl oleate, ethyl oleate, isopropyl oleate, butyl oleate, hexyl oleate, methyl linoleate, isobutyl linoleate, ethyl linoleate, butyl stearate, hexyl stearate, isooctyl stearate, isopropyl isostearate, 2-octyldodecyl pivalate, diisopropyl adipate, diisopropyl sebacate, diethyl sebacate, propylene glycol monocaprylate, trimethylolpropane tri(2-ethylhexanoate), and glyceryl tri(2-ethylhexanoate). Furthermore, ester-based solvents include esters of a drying oil fatty acid and an alcohol, such as soybean oil fatty acid methyl ester, soybean oil fatty acid isobutyl ester, linseed oil fatty acid methyl ester, linseed oil fatty acid butyl ester, linseed oil fatty acid propyl ester, linseed oil fatty acid 2-ethylhexyl ester, tung oil fatty acid methyl ester, tall oil fatty acid methyl ester, and tall oil fatty acid isobutyl ester.

Also, cyclic esters may be used, such as β-propiolactone, β-butyrolactone, γ-butyrolactone, γ-valerolactone, γ-caprolactone, σ-valerolactone, and ϵ-caprolactone.

Exemplary alcohol-based solvents include methyl alcohol, ethyl alcohol, propyl alcohol, butyl alcohol, isopropyl alcohol, and fluoroalcohols. Higher aliphatic alcohols having a carbon number of 12 or more may be used, and examples thereof include hexadecanol, isomyristyl alcohol, isopalmityl alcohol, isostearyl alcohol, and oleyl alcohol.

Polyhydric alcohols may be used, and examples thereof include ethylene glycol, diethylene glycol, triethylene glycol, polyethylene glycol, polypropylene glycol, propylene glycol, butylene glycol, 1,2,6-hexanetriol, thioglycol, hexylene glycol, glycerin, trimethylolethane, and trimethylolpropane.

Exemplary amide-based solvents include acetamide, dimethylacetamide, and N-methylpyrrolidine.

Exemplary fatty acid-based solvents include fatty acids having a carbon number of 4 or more, preferably 9 to 22, such as isononanoic acid, isomyristic acid, hexadecanoic acid, isopalmitic acid, oleic acid, and isostearic acid.

Exemplary ether-based solvents include glycol ethers, such as diethylene glycol monobutyl ether, ethylene glycol monobutyl ether, propylene glycol monobutyl ether, and propylene glycol dibutyl ether; and glycol ether acetates.

Exemplary ketones include acetone, methyl ethyl ketone, and cyclohexanone.

The polar organic solvent may contain amine, such as triethanolamine, tripropanolamine, tributanolamine, N,N-dimethyl-2-aminoethanol, N,N-diethyl-2-aminoethanol, and other hydroxylamines.

The above-cited compounds of the oil-based medium may be used singly or in combination, and the oil-based medium contains preferably 50% by mass or more, more preferably 60% by mass or more, of petroleum-based solvent. In this instance, the surfaces of the pigment particles are coated with the solvent. Consequently, the aggregation of the pigment particles is reduced, and the lubricity of the pigment surfaces is increased. Consequently, the pigment particles are stably dispersed in the recording liquid, and, thus, the resulting oil-based ink exhibits good ejection stability and produces highly color-developed images.

In particular, aromatic solvents, particularly naphthene-based solvents, are advantageous as the petroleum-based solvent from the viewpoint of uniformly dispersing the pigment. This is probably because the molecules of these solvents are similar to the molecule of the major constituent of the pigment in terms of polarity and molecular structure. Therefore, naphthene-based solvents are advantageous for further stabilizing ejection and highly developing the color of images.

Allyl Compound

Alternatively, an allyl compound may be used as the oil-based medium of the oil-based ink used in the present embodiment. α-Carbons of allyl compounds are likely to cause crosslinking reaction. Accordingly, when the oil-based medium contains an allyl compound, an oxidative polymerization of the ink is promoted. Therefore, the ink can have a low viscosity before being used recording, while the ink is rapidly hardened to have a high viscosity after being used recording, thus fixing the oil-based medium therein on the recording medium. Thus, the oil-based ink containing an allyl compound as an oil-based medium can be stably ejected, and accordingly, high quality images can be printed. In addition, the liquid ejecting method using such an oil-based ink can be used for high-speed printing.

The allyl compound is preferably, but is not limited to, a reactive compound that does not severely attack PP.

Allyl ethers are advantageous as the allyl compound from the viewpoint of reactivity. For example, compounds represented by the following general formula (1) are preferred:

(1)

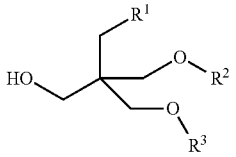

In general formula (1), $R^1$ represents a methyl group or —$OCH_2CHCH_2$; $R^2$ and $R^3$ each represent —$(CH_2)_nCH$-$CHR^4$; n represents an integer of 1 to 20; and $R^4$ represents H, an alkyl group having a carbon number of 1 to 8 or an aryl group having a carbon number of 6 to 8.

Among compounds of general formula (1), the compounds represented by the following formulas (2) and (3) are more preferred. These compounds each have a solubility parameter (SP value) of 9.5 or more and an iodine number of 120 or more.

(2)

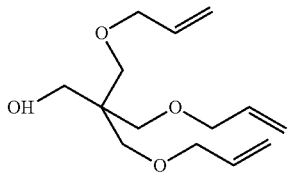

(3)

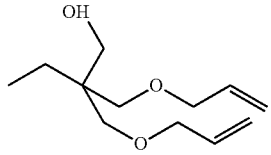

The compound represented by formula (2), which has an SP value of 12.6 and an iodine number of 297), and the compound represented by formula (3), which has an SP value of 11.5 and an iodine number of 231, are commercially available as, for example, Neoallyl P-30 and Neoallyl T-20 (each produced by Daiso Chemical).

The foregoing allyl compounds may be used singly or in combination.

Preferably, the allyl compound accounts for the major part of the oil-based medium, and the allyl compound content in the oil-based ink jet ink is preferably 50% by mass or more, more preferably 60% by mass or more, relative to the total mass of the oil-based ink jet ink.

1.2.3. Resin

The oil-based ink used in the present embodiment contains a resin as a dispersant. A dispersant selected from the known dispersants used in ordinary oil-based inks may be used as the resin for stably dispersing the pigment in the oil-based ink. In the present embodiment, any pigment dispersant may be used as long as it can stably disperse the pigment in the oil-based medium, and examples of the dispersant include Solsperse 5000, Solsperse 13940, Solsperse 11200, Solsperse 21000, and Solsperse 28000, each produced by Lubrizol.

In particular, it has been found that urethane-modified acrylic resins, fatty acid-modified alkyd resins, and urethane-modified alkyd resins are useful as the resin for coating the surfaces of the pigment particles, including the active sites at the surfaces, to disperse the pigment uniformly. If any of these resins is used as the dispersant, the pigment is stably dispersed in the ink, and thus, the ink can be formed into satisfactory droplets when being ejected through the nozzles of the ink jet head. Consequently, the ink can be stably ejected, particularly continuously stably ejected in high-speed line ink jet recording. In addition, since the pigment is stably dispersed in the ink, the resulting images exhibit high color development and satisfactory fastness.

The dispersant content in the oil-based ink used in the present embodiment may be appropriately determined according to the pigment to be dispersed. Preferably, the proportion of the dispersant, or resin, dissolved in the oil-based medium is in the range of 0.1% by mass to 10% by mass, more preferably 1% by mass to 5% by mass, relative to the total mass of the oil-based ink. The resin "dissolved" in the oil-based medium refers to the resin present in the continuous oil-based medium phase without being adsorbed to the surfaces of the pigment. When the resin is contained in such a range, the pigment is more stably dispersed in the ink, and accordingly, the resulting images exhibit high color development and satisfactory fastness. The mass ratio (mass of the pigment/mass of the dispersion) of the pigment to the dispersion in the oil-based ink is preferably in the range of 0.5 to 2.0, more preferably in the range of 1.0 to 1.5.

1.2.4. Other Ingredients

The oil-based ink used in the present embodiment may further contain additives that are generally contained in ordinary oil-based inks. Exemplary additives include stabilizers, such as an antioxidant and an ultraviolet absorbent, a surfactant, and a binder resin.

Antioxidant

Examples of the antioxidant include BHA (2,3-butyl-4-oxyanisole) and BHT (2,6-di-t-butyl-p-cresol).

Ultraviolet Absorbent

Examples of the ultraviolet absorbent include benzophenone-based compounds and benzotriazole-based compounds.

Binder Resin

The oil-based ink used in the present embodiment may contain a binder resin to fix the pigment to the recording medium and to control the viscosity of the ink. Examples of the binder resin include acrylic resins, styrene acrylic resins, rosin-modified resins, phenol resins, terpene resins, polyester resins, polyamide resins, epoxy resins, vinyl chloride-vinyl acetate copolymer resins, cellulose acetate butyrate and other textile fabric resins, and vinyl toluene-α-methylstyrene copolymer resins. These binder resins may be used singly or in combination. These resins can increase the fixability of the ink to the recording medium and the fastness to rubbing of the resulting recorded article.

The solids content of the binder resin in the oil-based ink is preferably in the range of 0.05% by mass to 15% by mass, more preferably 0.1% by mass to 10% by mass, and still more preferably 1% by mass to 5% by mass.

Surfactant

The oil-based ink used in the present embodiment may contain a surfactant, such as a silicone surfactant, a fluorosurfactant, or a polyoxyethylene derivative acting as a nonionic surfactant, from the viewpoint of reducing the surface tension and thus increasing the wettability on the recording medium.

Preferred examples of the silicone surfactant include polyester-modified silicones and polyether-modified silicones. Examples of such a silicone surfactant include BYK-315, BYK-315N, BYK-347, BYK-348, BYK-UV 3500, BYK-UV 3510, BYK-UV 3530, and BYK-UV 3570 (each produced by BYK).

The fluorosurfactant may be a fluorine-modified polymer, and examples thereof include BYK-340 (produced by BYK); Surflon series S-211, S-131, S-132, S-141, S-144, and S-145 (each produced by AGC Seimi Chemical); Ftergent series 100, 150, and 251 (produced by Neos); Megafac F477 (produced by DIC); Fluorad series FC-170C, FC-430, and FC4430 (each produced by Sumitomo 3M); FSO, FSO-100, FSN, FSN-100, and FS-300 (each produced by Dupont); and FT-250 and FT-251 (each produced by Neos).

An example of preferred polyoxyethylene derivatives may be an acetylene glycol-based surfactant. Examples thereof include Surfynol series 82, 104, 465, 485, and TG (each produced by Air Products); Olfine series STG and E1010 (each produced by Nissin Chemical Industry); Nissan Nonion series: A-10R and A-13R (each produced by NOF Corporation); FLOWLEN series: TG-740W and D-90 (produced by Kyoeisha Chemical); and NOIGEN CX-100 (produced by Dai-ichi Kogyo Seiyaku).

The surfactant content in the oil-based ink is preferably in the range of 0.05% by mass to 3% by mass, more preferably 0.1% by mass to 2% by mass, and still more preferably 0.5% by mass to 1% by mass.

The oil-based ink used in the present embodiment may contain further constituents, such a pH adjuster, a chelating agent such as an ethylenediaminetetraacetic acid salt (EDTA salt), a preservative or fungicide, and a rust preventive, to impart desired properties.

1.2.5. Method for Preparing Oil-Based Ink

The oil-based ink used in the present embodiment can be prepared by a conventional method. A pigment dispersion liquid is, first, prepared so that the resulting ink can have desired properties, by mixing a pigment, a dispersant, and a portion of an oil-based medium, and agitating the mixture with a ball mill, a bead mill, an ultrasonic mill, a jet mill, or the like. Subsequently, the rest of the oil-based medium and other ingredients, such as a surfactant and a binder resin, are added to the dispersion liquid with stirring to yield the oil-based ink.

1.2.6. Physical Properties

Preferably, the oil-based ink has a surface tension at 20° C. in the range of 20 mN/m to 50 mN/m, more preferably in the range of 25 mN/m to 40 mN/m, from the viewpoint of the balance between the quality of recorded articles and the reliability of the ink as an ink jet ink. The surface tension can be determined by measuring the ink wetting a platinum plate at 20° C. with an automatic surface tensiometer CBVP-Z (manufactured by Kyowa Interface Science).

Also, from the same viewpoint as above, the oil-based ink preferably has a viscosity in the range of 2 mPa·s to 30 mPa·s, more preferably in the range of 2 mPa·s to 20 mPa·s, at 20° C. The viscosity can be measured with a viscoelasticity meter MCR-300 (manufactured by Pysica) by increasing the shear rate to 10 to 1000 at 20° C. and reading the indicated value of the meter at a shear rate of 200.

1.3. Liquid Ejecting Method

A liquid ejecting method according to an embodiment of the invention will now be described. The liquid ejecting method of the present embodiment is used for recording on a recording medium using an oil-based ink and an ink jet recording apparatus.

1.3.1. Recording Medium

In the present embodiment, any recording medium may be used without particular limitation, and examples thereof include plain paper, coated paper, cloth, and leather. These recording media may be non-absorbent or poorly absorbent of ink.

The recording medium poorly absorbent of ink (hereinafter referred to as ink-low-absorbent recording medium) may be provided with a coating layer capable of receiving ink on the surface thereof. For example, the ink-low-absorbent recording medium may have a paper base, and examples of such a recording medium include book-printing paper, such as art paper, coated paper, or matte paper. Also, the ink-low-absorbent recording medium may have a plastic base, and examples of such a recording medium include films of polyvinyl chloride, polyethylene terephthalate, polycarbonate, polystyrene, polyurethane, polyethylene, polypropylene, or the like coated with a hydrophilic polymer or a coating formed by applying silica or titanium particles together with a binder. The recording medium may be transparent.

1.3.2. Step of Ejecting Droplets of Oil-Based Ink

The step of ejecting droplets will now be described. In the present embodiment, droplets of the oil-based ink are ejected onto the surface of a recording medium for recording an image in this step. Thus, an image of the oil-based ink is formed on the surface of the recording medium.

The term "image" mentioned herein refers to a printed pattern defined by dots, including a printed character and a solid pattern. A solid pattern mentioned herein refers to a pattern defined by only pixels filled with printed dots in such a manner that the recording region of the recording medium is covered with an ink so that the surface of the recording medium is not exposed, and the pixel refers to the minimum unit of a recording area, defining a recording resolution.

In the liquid ejecting method of the present embodiment, droplets of an oil-based ink containing an oil-based medium are ejected onto a recording medium by using a line ink jet head 20 having a plurality of nozzles under the conditions satisfying the following relationships (1) and (2):

$$f \times D \geq 4800 \quad (1); \text{ and}$$

$$5 \leq \rho V d / \eta \leq 30 \quad (2).$$

In the relationships (1) and (2), D represents the nozzle pitch in dpi of the line ink jet head 20, f represents the maximum ejection frequency in kHz, V represents the velocity in m/s of droplets ejected from the head, d represents the diameter in μm of the droplets of the oil-based ink, ρ represents the density in g/cm$^3$ of the oil-based ink, and η represents the viscosity in mPa·s of the oil-based ink.

In this liquid ejecting method, the ink jet recording apparatus and the oil-based ink are adjusted to satisfy relationships (1) and (2). Consequently, the oil-based ink can be stably ejected onto a recording medium by an ink jet method, and thus high quality images can be printed. In addition, the liquid ejecting method can be used for high-speed printing.

The reason why this liquid ejecting method enables high-speed printing using a line ink jet head 20 to form high-quality images while ensuring an ejection stability may be as follows.

In a piezoelectrically driven line ink jet head, the ink is temporarily delivered to the reservoir 28 of the line ink jet head 20 from the ink cartridge 35, and then supplied to the pressure chamber 24 provided for each nozzle 21 through the supply port 29. In the pressure chamber 24, the ink is exposed to a pressure generated by the vibration of the piezoelectric element 25 and thus ejected through the communication hole 27 and the nozzle 21. In order to stably eject the ink through the nozzles 21, the ink is appropriately kept fluid in the flow channels including the reservoir 28. Since the reservoir 28 communicates with each of the nozzles 21, parameters depending on the fluidity of the ink in the flow channels include the density of the nozzles (nozzle pitch D), the frequency of ejection through each nozzle, piezoelectric displacement, and ink properties.

The piezoelectric displacement and the ink properties are inseparable in view of ensuring an appropriate fluidity in the region from the pressure chamber 24 to the nozzle 21 through the communication hole 27, that is, in the ink flow channels of the ink jet head. The fluidity is appropriately controlled by controlling the Reynolds number Re of the ink in an appropriate range, 5 to 30, wherein the Reynolds number Re is calculated from the parameters: velocity of ejected droplets, which correlates to the piezoelectric displacement; the viscosity and the density of the ink, which are ink properties; and the sphere-equivalent diameter of the ink droplets, which correlates to the dynamic surface tension of the ink. If the Reynolds number Re exceeds 30, turbulent flow occurs in a flow channel and causes crosstalk that can affect the ink flowing in another flow channel communicating with the reservoir 28, thus causing long-period inconsistencies in density in the resulting image.

Solid patterns recorded by a known liquid ejecting method may have inconsistencies in density with a long period (from several millimeters to several centimeters), depending on the recorded pattern and the recording speed. On the other hand, in the liquid ejecting method of the present embodiment, ink jet recording apparatus and the oil-based ink are adjusted to satisfy relationships (1) and (2) to eliminate such long-period inconsistencies in density so that high-quality images can be printed.

The control of the Reynolds number (Re) is required when the amount per unit time of the ink flowing in the ink flow channel exceeds a threshold, and it has been confirmed that this amount has a correlation with the product of ejection frequency and nozzle pitch. Therefore, the threshold (4800) of relationship (1) is determined by using these values.

In the liquid ejecting method of the present embodiment, the diameter d of the droplets of the oil-based ink is preferably in the range of 20 μm to less than 50 μm. When the diameter d of the droplets is in this range, the liquid ejecting method further ensures stable ink jet ejection of the oil-based ink onto a recording medium and thus enables high-quality image printing. In addition, the liquid ejecting method can be used for high-speed printing.

Preferably, the droplets of the oil-based ink have a Weber number We in the range of 25 to 100, and a Reynolds number Re of which the product multiplied by the Weber number We is in the range of 200 to 1500. The Weber number is represented by equation (3): $We=\rho V^2 d/\gamma$, and the Reynolds number Re is represented by equation (4): $Re=\rho V d/\eta$. $\gamma$ Represents the surface tension in mN/m of the oil-based ink.

In this instance, the oil-based ink can be more stably ejected onto a recording medium by an ink jet method, and accordingly the liquid ejecting method enables high-quality images to be printed. In addition, the liquid ejecting method can be used for high-speed printing.

The maximum amount of the oil-based ink applied to the surface of the recording medium is preferably in the range of 5 mg/inch$^2$ to 15 mg/inch$^2$. When the maximum amount of the oil-based ink applied to the surface of the recording medium is in this range, the recording speed is increased.

In the liquid ejecting method of the present embodiment, the ink jet recording apparatus and the oil-based ink are adjusted to satisfy the above described equations. Consequently, this method further ensures stable ink jet ejection of the oil-based ink onto a recording medium particularly in high-speed printing and thus enables high-quality image printing.

2. Examples

The subject matter of the invention will now be further described in detail with reference to Examples and Comparative Examples. However, the invention is not limited to the Examples. In the following Examples and Comparative Examples, "part(s)" and "%" are on a mass basis unless otherwise specified.

2.1. Preparation of Inks

Ink 1

A 20 L stainless-steal reactor with a jacket was charged with 500 g of carbon black #2350 (produced by Mitsubishi Chemical), 300 g of a dispersant Solsperse 13940 (produced by Lubrizol), and 9200 g of Exxsol D130 (produced by Exxon Mobil). These ingredients were stirred with Dissolver manufactured by Inoue MFG. for 1 hour while being cooled with water. The resulting mixture was agitated for 3 hours by a cycling operation with a media disperser Nao Getter (manufactured by Ashizawa Finetech, 90% filled with zirconia beads of 0.03 mm in diameter). Subsequently, the mixture was subjected to centrifugation at an acceleration of 11,000 G for 10 minutes in a cooling centrifuge CR7N (manufactured by Hitachi Koki), followed by filtration through a filter of 3 μm in pore size to yield Ink 1.

Ink 2

A 20 L stainless-steal reactor with a jacket was charged with 500 g of carbon black #2350 (produced by Mitsubishi Chemical), 300 g of a dispersant Solsperse 13940 (produced by Lubrizol), 4000 g of Exxsol D130 (produced by Exxon Mobil), 4000 g of methyl oleate (produced by Toei Chemical), and 1200 g of hexadecyl alcohol (produced by Kokyu Alcohol Kogyo), and Ink 2 was prepared in the same manner as Ink 1.

Ink 3

A 20 L stainless-steal reactor with a jacket was charged with 500 g of carbon black #2350 (produced by Mitsubishi Chemical), 300 g of a dispersant Solsperse 13940 (produced by Lubrizol), 8000 g of methyl oleate (produced by Toei Chemical), and 1200 g of hexadecyl alcohol (produced by Kokyu Alcohol Kogyo), and Ink 3 was prepared in the same manner as Ink 1.

Ink 4

A 20 L stainless-steal reactor with a jacket was charged with 500 g of carbon black #2350 (produced by Mitsubishi Chemical), 300 g of a dispersant Solsperse 13940 (produced by Lubrizol), and 9200 g of Neoallyl™ P-30 (produced by Daiso) as allyl ether A, and Ink 4 was prepared in the same manner as Ink 1.

Ink 5

A 20 L stainless-steal reactor with a jacket was charged with 500 g of carbon black #2350 (produced by Mitsubishi Chemical), 300 g of a dispersant Solsperse 13940 (produced by Lubrizol), and 9200 g of Neoallyl™ T-20 (produced by Daiso) as allyl ether B, and Ink 5 was prepared in the same manner as Ink 1.

The compositions of Inks 1 to 5 are shown in Table 1. The numerals in Table 1 are each represented in percent by mass.

TABLE 1

| | Ink 1 | Ink 2 | Ink 3 | Ink 4 | Ink 5 |
|---|---|---|---|---|---|
| Carbon black #2350 | 5 | 5 | 5 | 5 | 5 |
| Solsperse 13940 | 3 | 3 | 3 | 3 | 3 |
| Exxsol D130 | 92 | 40 | 0 | 0 | 0 |
| Methyl oleate | 0 | 40 | 80 | 0 | 0 |
| Allyl ether A | 0 | 0 | 0 | 92 | 0 |

TABLE 1-continued

| | Ink 1 | Ink 2 | Ink 3 | Ink 4 | Ink 5 |
|---|---|---|---|---|---|
| Allyl ether B | 0 | 0 | 0 | 0 | 92 |
| Hexadecyl alcohol | 0 | 12 | 12 | 0 | 0 |

2.2. Evaluation 2.2.1. Ink Jet Head Driving Conditions

An ink jet head with a nozzle pitch of 600 dpi was used. The ink jet head was connected to a head controller that can control the ejection frequency and the piezoelectric driving current and was charged with Ink 1. A recording signal was transmitted to the ink jet head from the head controller to eject the ink. The behavior of ink droplets ejected from the head was recorded by a high-speed camera, and the velocity and the sphere-equivalent diameter of the droplets at 1 mm from the nozzles were calculated from the record. The piezoelectric driving current was adjusted so that the velocity of ejected droplets could be the value shown in Table 2.

2.2.2. Print Quality

The ink jet head was mounted in an ink jet printer modified from PX-7050 manufactured by Seiko Epson. The head controller was connected to the ink jet head, and continuous printing was performed at an adjusted piezoelectric driving current and an ejection frequency, each shown in Table 2 by transmitting test pattern data to the ink jet head and transporting a roll paper (plain paper) at a speed corresponding to 100 ppm (piece per minute) for A4 sheet. After an amount of the roll paper corresponding to 1000 A4 sheets was transported, a 5 cm×5 cm square solid area (for checking for long-period inconsistencies in density), in the test pattern, 2-point characters (for checking for bleeding), and 1-dot-width vertical and horizontal lines (for checking for deviation and bent) of the test pattern were visually examined and evaluated according to the following criteria:

5: Percentage of defects: less than 0.1%

4: Percentage of defects: 0.1% to less than 1%

3: Percentage of defects: 1% to less than 5%

2: Percentage of defects: 5% to less than 10%

1: Percentage of defects: 10% or more 2.3. Evaluation Results

Evaluation results are shown in Table 2.

The evaluation results of Comparative Example 1, which did not satisfy relationship (1), and Comparative Example 2, which did not satisfy either relationship (1) or relationship (2), were not good, and the quality of the resulting images thereof were not improved. On the other hand, the images of the Examples were evaluated to be better than those of the Comparative Examples, and the image quality particularly in Examples 1, 2, 7, and 8 were much improved. Thus, it has been found that the ink can be stably ejected and thus can form high-quality images in high-speed one pass recording using a line ink jet head by controlling the physical properties of the ink and the ejection conditions for high density, high speed printing so as to satisfy the above-described relationships.

The invention is not limited to the above-described embodiments and Examples, and various modifications may be made. For example, the invention includes substantially the same form as the disclosed embodiments (for example, a form including the same function and method and producing the same result, or a form having the same intent and producing the same effect). Some elements unessential to the form of the disclosed embodiment may be replaced. The form of an embodiment of the invention includes an element producing the same effect or achieving the same object, as the form of the disclosed embodiments. The forms of the disclosed embodiments may be combined with the known art.

The entire disclosure of Japanese Patent Application No. 2016-128512, filed Jun. 29, 2016 is expressly incorporated by reference herein.

What is claimed is:

1. A liquid ejecting method comprising:

ejecting droplets of an oil-based ink containing an oil-based medium onto a recording medium by using an ink jet head having a plurality of nozzles under the conditions satisfying the following relationships:

$$f \times D \geq 4800 \quad (1); \text{ and}$$

$$5 \leq \rho V d / \eta \leq 30 \quad (2),$$

wherein D represents the nozzle pitch in dpi of the ink jet head, f represents the maximum ejection frequency

TABLE 2

| | Example 1 | Example 2 | Example 3 | Example 4 | Example 5 | Example 6 | Example 7 | Example 8 | Comparative Example 1 | Comparative Example 2 |
|---|---|---|---|---|---|---|---|---|---|---|
| Maximum ejection frequency f (kHz) | 12 | 8 | 12 | 12 | 12 | 12 | 12 | 12 | 4 | 12 |
| Nozzle pitch D (dpi) | 600 | 600 | 600 | 600 | 600 | 600 | 600 | 600 | 300 | 600 |
| f × D | 7200 | 4800 | 7200 | 7200 | 7200 | 7200 | 7200 | 7200 | 1200 | 7200 |
| Droplet diameter d (μm) | 22 | 21 | 22 | 23 | 18 | 36 | 22 | 22 | 39 | 39 |
| Velocity V (m/s) of ejected droplets | 7 | 7 | 11 | 7 | 7 | 11 | 7 | 7 | 7 | 11 |
| Ink | Ink 1 | Ink 1 | Ink 1 | Ink 2 | Ink 1 | Ink 1 | Ink 4 | Ink 5 | Ink 1 | Ink 3 |
| Ink density ρ ($g/cm^3$) | 0.83 | 0.83 | 0.83 | 0.85 | 0.83 | 0.83 | 0.83 | 0.83 | 0.83 | 0.87 |
| Ink viscosity η (mPa · s) | 12 | 12 | 12 | 14 | 12 | 12 | 13 | 12 | 12 | 12 |
| Ink surface tension γ (mN/m) | 29 | 29 | 29 | 31 | 29 | 29 | 30 | 29 | 29 | 29 |
| Reynolds number Re | 11 | 10 | 17 | 10 | 9 | 27 | 10 | 11 | 19 | 31 |
| Weber number (We) | 31 | 30 | 75 | 30 | 26 | 133 | 30 | 31 | 55 | 142 |
| Re × We | 329 | 299 | 1275 | 302 | 220 | 3415 | 318 | 307 | 1032 | 4403 |
| Image Quality | 5 | 5 | 4 | 4 | 3 | 2 | 5 | 5 | 1 | 1 |

in kHz, V represents the velocity in m/s of the droplets ejected from the ink jet head, d represents the diameter in μm of the droplets, ρ represents the density in $g/cm^3$ of the oil-based ink, and η represents the viscosity in mPa·s of the oil-based ink.

2. The liquid ejecting method according to claim 1, wherein the oil-based medium contains a petroleum-based solvent with a content of 50% by mass or more relative to the total mass of the oil-based medium.

3. The liquid ejecting method according to claim 1, wherein the oil-based medium contains an allyl compound.

4. The liquid ejecting method according to claim 1, wherein the diameter d is in the range of 20 μm to less than 50 μm.

5. The liquid ejecting method according to claim 1, wherein the droplets of the oil-based ink have a Weber number We in the range of 25 to 100, and a Reynolds number Re of which the product multiplied by the Weber number We is in the range of 200 to 1500, and wherein the Weber number is represented by equation (3): $We=\rho V^2 d/\gamma$, where γ represents the surface tension in mN/m of the oil-based ink, and the Reynolds number Re is represented by equation (4): $Re=\rho V d/\eta$.

6. The liquid ejecting method according to claim 1, wherein the ink jet head is a line ink jet head in which the plurality of nozzles are arranged in a direction intersecting the direction in which the recording medium is transported.

* * * * *